US008490331B2

(12) United States Patent
Quesada

(10) Patent No.: US 8,490,331 B2
(45) Date of Patent: Jul. 23, 2013

(54) ROLLER FOR A SLIDING PANEL ASSEMBLY, AND METHOD OF INSTALLING A SLIDING PANEL ASSEMBLY

(75) Inventor: Flavio Quesada, Miami, FL (US)

(73) Assignee: CGI Windows & Doors, Miami, FL (US)

( * ) Notice: Subject to any disclaimer, the term of this patent is extended or adjusted under 35 U.S.C. 154(b) by 404 days.

(21) Appl. No.: 12/557,848

(22) Filed: Sep. 11, 2009

(65) Prior Publication Data

US 2011/0061305 A1 Mar. 17, 2011

(51) Int. Cl.
*E05D 15/06* (2006.01)

(52) U.S. Cl.
USPC ..... 49/425; 49/427; 49/411; 49/404; 16/18 R; 16/45; 16/47

(58) Field of Classification Search
USPC ..... 49/404, 411, 425, 427, 414, 420, 49/421; 16/30, 42 R, 18 R, 45, 47, 49
See application file for complete search history.

(56) References Cited

U.S. PATENT DOCUMENTS

| | | | | |
|---|---|---|---|---|
| 3,517,459 | A * | 6/1970 | Schupper | 49/425 |
| 4,102,009 | A * | 7/1978 | Kelly | 16/100 |
| 4,189,870 | A | 2/1980 | Helmick | |
| 4,262,451 | A * | 4/1981 | Dallaire | 49/425 |
| 4,282,631 | A * | 8/1981 | Uehara et al. | 16/102 |
| 4,633,615 | A * | 1/1987 | Moose | 49/425 |
| 5,860,189 | A * | 1/1999 | An | 16/91 |
| 5,950,279 | A | 9/1999 | Chaput | |
| 6,021,547 | A * | 2/2000 | Stagoll | 16/105 |
| 6,209,171 | B1 * | 4/2001 | Pelletier et al. | 16/97 |
| 6,463,625 | B2 | 10/2002 | Mittag | |
| 6,681,445 | B2 * | 1/2004 | Huang | 16/105 |
| 6,983,512 | B2 | 1/2006 | De Oliveira | |
| 7,021,007 | B2 * | 4/2006 | Jacobs | 49/425 |
| 2001/0054258 | A1 * | 12/2001 | Becken | 49/409 |
| 2005/0246962 | A1 * | 11/2005 | Jacobs | 49/425 |
| 2009/0019665 | A1 * | 1/2009 | Kelley | 16/105 |

FOREIGN PATENT DOCUMENTS

GB 2087961 A * 6/1982

* cited by examiner

*Primary Examiner* — Katherine Mitchell
*Assistant Examiner* — Marcus Menezes
(74) *Attorney, Agent, or Firm* — Greenblum & Bernstein P.L.C.

(57) ABSTRACT

A roller for sliding a movable panel includes a housing and a plurality of wheels positioned within the housing. The housing is positionable in a space defined between a bottom surface of the panel and a channel which receives a guided edge of the panel.

9 Claims, 7 Drawing Sheets

ROLLER FOR A SLIDING PANEL ASSEMBLY, AND METHOD OF INSTALLING A SLIDING PANEL ASSEMBLY

BACKGROUND OF THE INVENTION

I. Field of the Invention

The present invention relates generally to a roller for a sliding panel assembly and a method of installing the sliding panel assembly.

II. Discussion of the Background Art

A conventional sliding panel assembly (e.g., a sliding window or door) installation has a frame provided with a channel along a lower edge of the frame opening and at least one fixed panel and one sliding panel positioned in the frame opening. Other conventional sliding panel assemblies include two or more sliding panels and no fixed panels. The sliding panel is moveable edgewise between open and closed positions. For example, the lower edge of the sliding panel may include supporting rollers which ride in the lower frame channel and an upper edge guided within an upper side of the frame.

Conventional sliding panel assemblies incorporating the above-described supporting roller often makes the sliding panel difficult to move and wheels of the supporting rollers often break due to the excessive weight the supporting rollers must support. Other conventional sliding panel assemblies have overhead-type roller assemblies that support the weight of the panel; however, in such overhead-type sliding panel assemblies, the weight of the panel on the roller assemblies has the potential of pulling the rollers off their respective tracks, and dislodging the sliding panel.

SUMMARY OF THE INVENTION

The invention of the present invention provides an easy to install a roller capable of stably supporting and distributing the weight of a movable panel. Further, the present invention exhibits improved structural integrity without compromising the rolling characteristics of the roller. Additionally, since sliding panel rests atop the roller (i.e., the force resulting from the weight of the sliding panel is exerted on the roller from above), the weight of the sliding panel further ensures that the roller is securely positioned within the channel in which the roller slides, thereby further reducing the risk of the sliding panel being accidentally dislodged from its installation.

These and other features of the present disclosure will be apparent from review of the specification and accompanying drawings.

Accordingly, a non-limiting embodiment of the present invention provides a roller for sliding a movable panel. In this regard, the roller may include a housing and a plurality of wheels positioned within the housing. Additionally, the roller is configured to be positioned in a space defined between a bottom surface of the panel and a channel configured to receive a guided edge of the panel.

In an additional feature, the plurality of wheels may include a first pair of wheels and a second pair of wheels. For example, the first pair of wheels may be positioned at a first end of the housing and the second pair of wheels may be positioned at a second end of the housing.

In another feature, the housing may include alignments tabs proximate at least one of a first end of the housing and a second end of to housing. In this regard, the alignment tabs may be configured to align at least one of the first and second ends of the housing with an edge of the guided edge of the panel.

In yet another non-limiting embodiment of the present invention, the roller may include a clip coupled to an upper surface of the housing and configured to be connected to the bottom surface of the panel. Further, the lower surface of the clip may include a projection positioned within a recess provided on the upper surface of the housing.

In a further feature, the projection may be provided at a central portion of the lower surface of the clip and the recess may be provided at a central portion of the upper surface of the housing. Additionally, the clip may include a flange extending generally perpendicular to the upper surface of the housing, and the flange may be received within a housing groove provided in at least one of a first end of the housing and a second end of the housing. Furthermore, the flange may include a flange aperture aligned with a housing aperture provided in the at least one of the first and second ends of the housing. In this regard, a fastener may be received within the flange aperture and the housing aperture so as to couple the clip and the housing together.

Additionally, the roller may be included in a sliding panel assembly. In this regard, the sliding panel assembly may include a sliding panel having a guided edge, a channel which receives the guided edge of the panel, and a roller having a housing and a plurality of wheels positioned within the housing. Further, the roller is configured to be positioned in a spaced defined between a bottom surface of the panel and the channel.

In a further feature, the plurality of wheels of the roller, included in the sliding panel assembly, may include a first pair of wheels and a second pair of wheels. Additionally, the first pair of wheels may be positioned at a first end of the housing and the second pair of wheels may be positioned at a second end of the housing.

In an additional feature, a clip may be coupled to an upper surface of the housing and connected to the bottom surface of the panel. Furthermore, the channel may include a window sill and the sliding panel may include a window panel. In another non-limiting embodiment the channel may include a door channel and the sliding panel may include a door.

According to another feature, the channel may include recessed pathways provided at opposing sides of the channel. In this regard, the recessed pathways may define a sub-track which receives and guides the plurality of wheels.

According to an additional feature, the roller included in a sliding panel assembly, may include at least first and second roller assemblies. In this regard, the first roller may be positioned at a first end of the guided edge and the second roller may be positioned at a second end of the guided edge. Additionally, an upper surface of the housing may be coupled to the bottom surface of the panel (e.g., via a connecting pin).

In another feature of the present invention, a lower surface of the clip may include a projection positioned within a recess provided on the upper surface of the housing.

Further, a non-limiting method of installing a sliding panel assembly of the present invention may include, inserting a lower guided edge of a sliding panel into a lower channel, rotating an upper guided edge of the panel towards an upper channel, raising the panel so that the upper guided edge is inserted into the upper channel, and positioning a roller in a space defined between a bottom surface of the lower guided edge and the lower channel. In this regard, a window or door may be provided as the panel.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
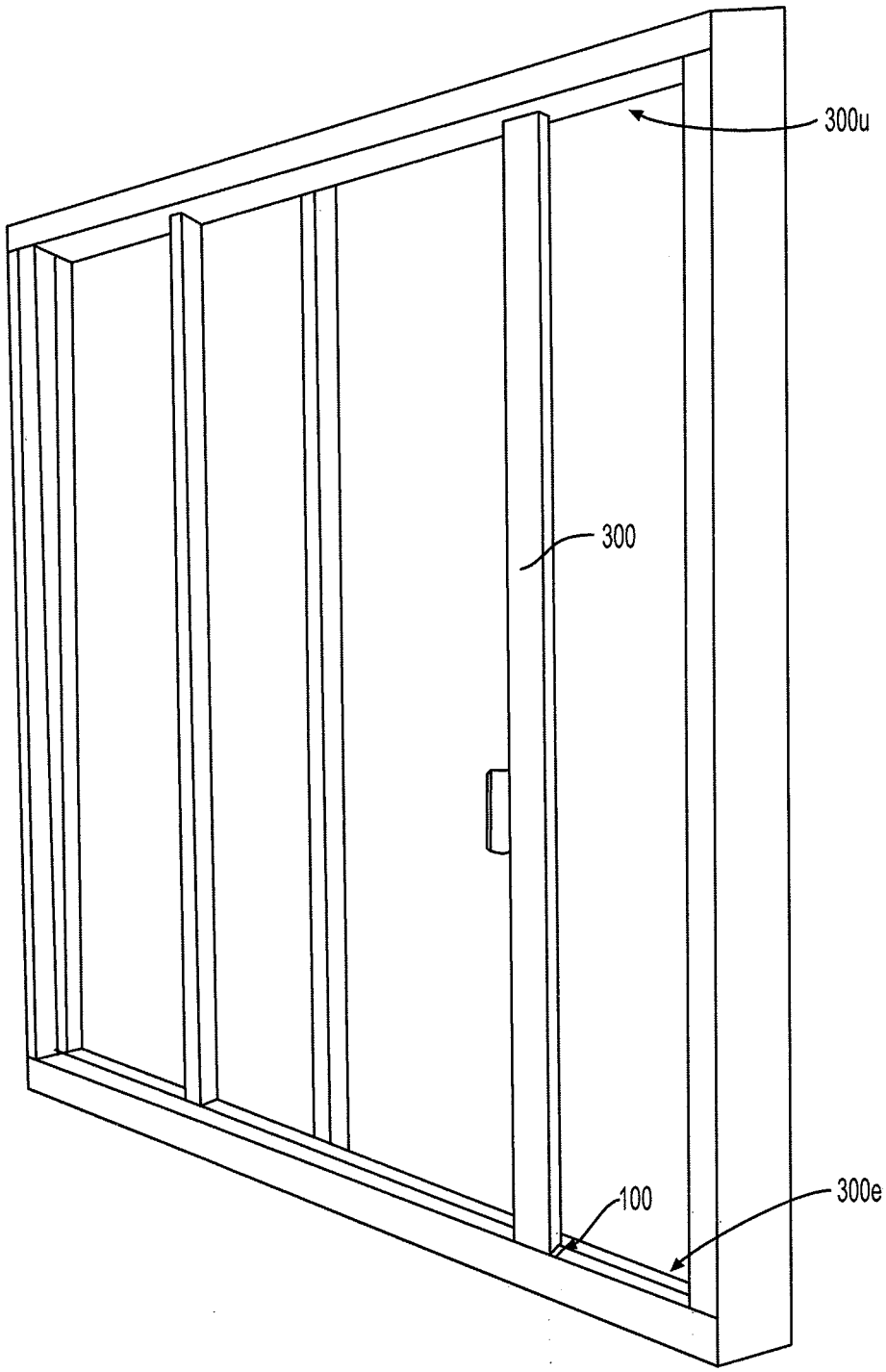
FIG. 1 is a perspective view of a sliding panel incorporating a roller according to a non-limiting embodiment of the present invention.
Figure 2:
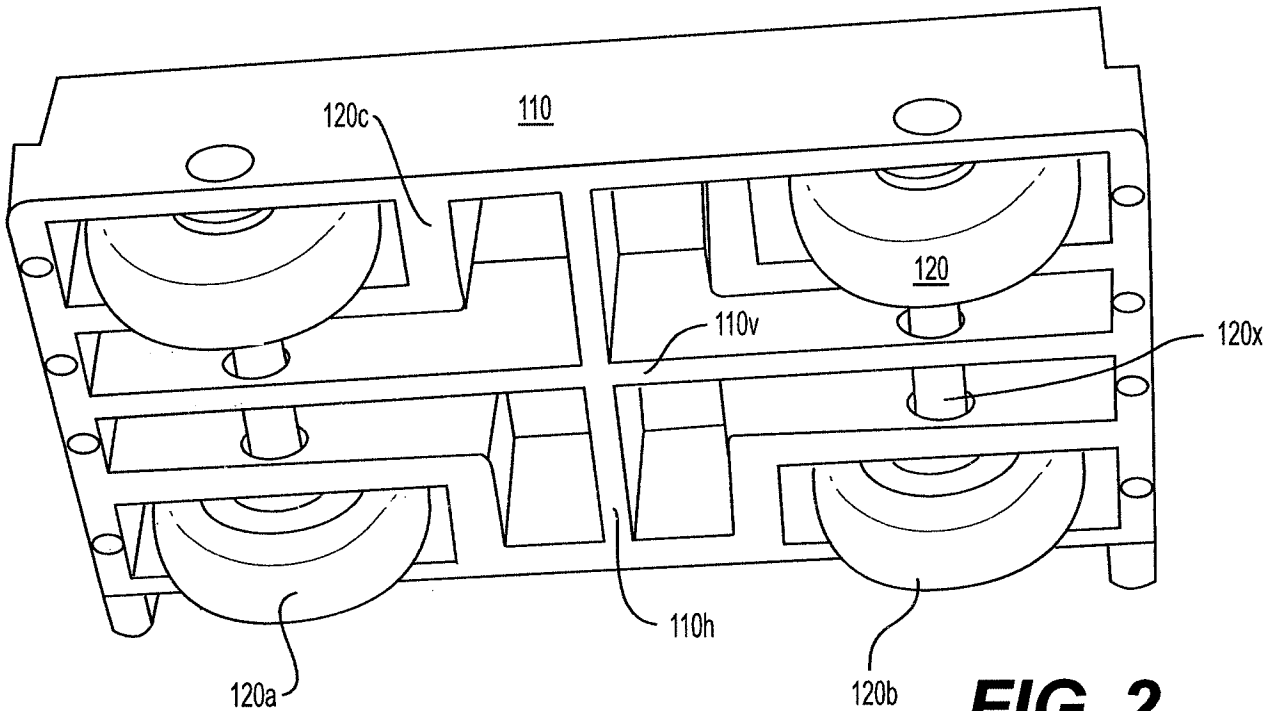
FIG. 2 is a bottom perspective view of the roller illustrating a plurality of wheels positioned within the roller housing.
Figure 5:
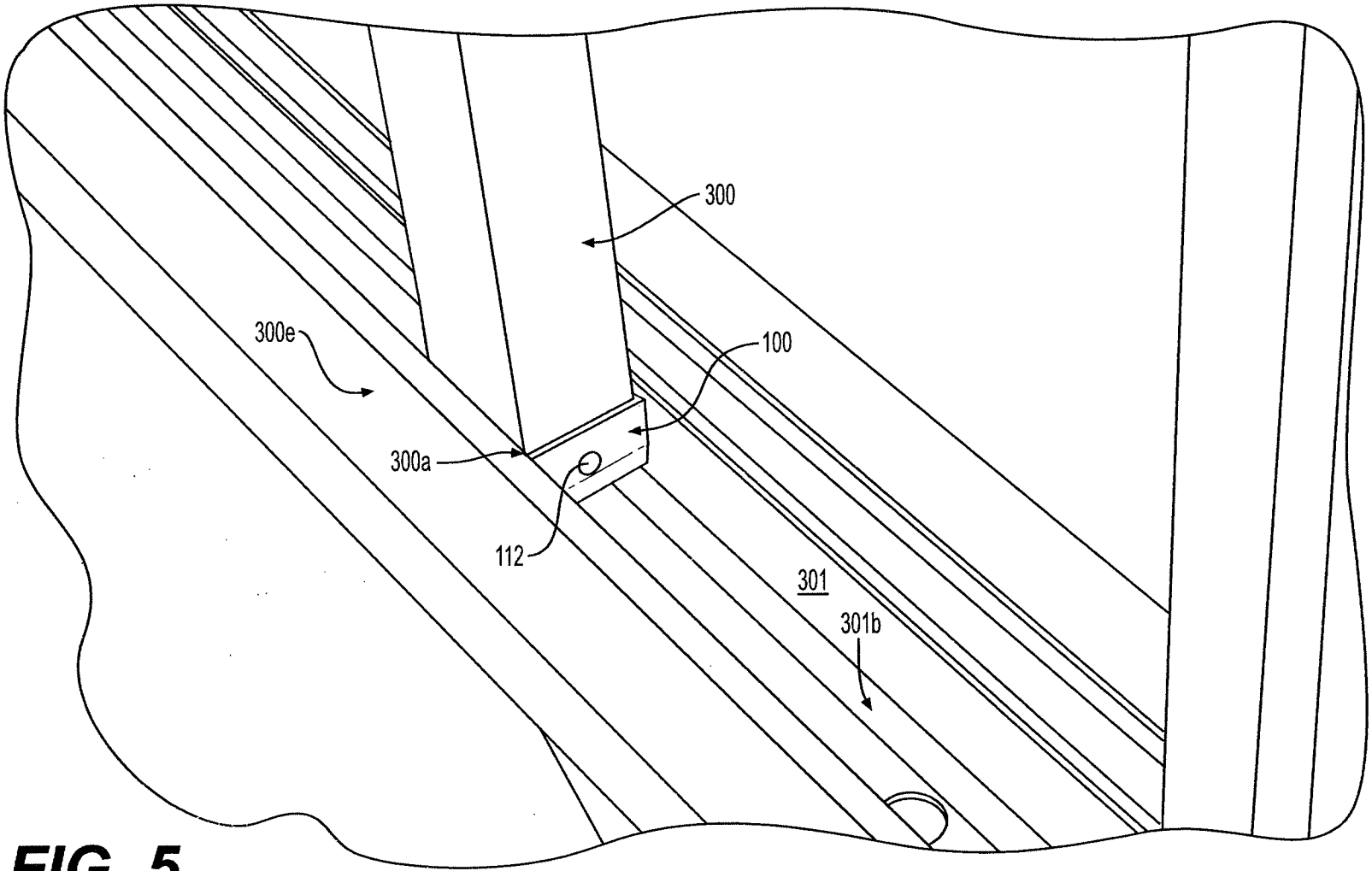
FIG. 5 is a perspective view of the roller positioned between a bottom surface of the panel and the channel.
Figure 6:
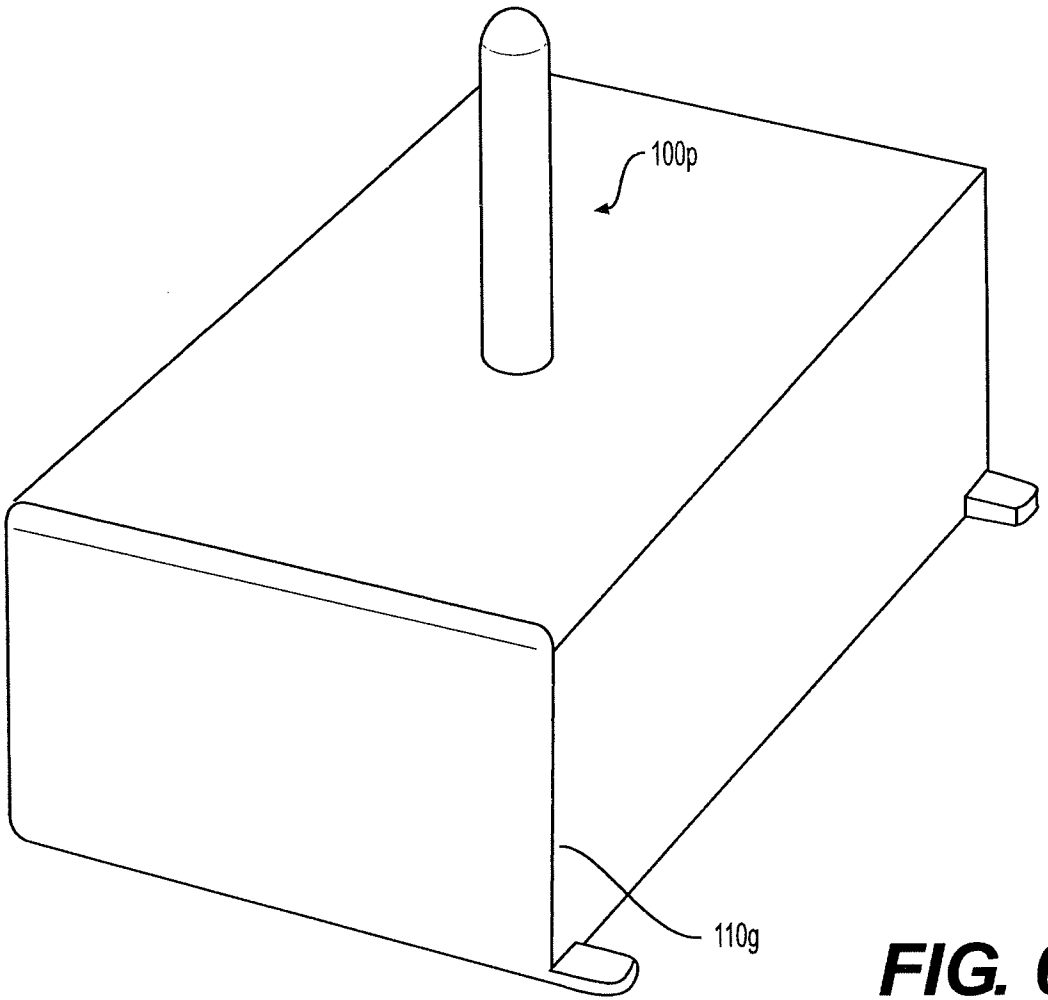
FIG. 6 is a perspective view of the roller incorporating a connecting pin.
Figure 7:
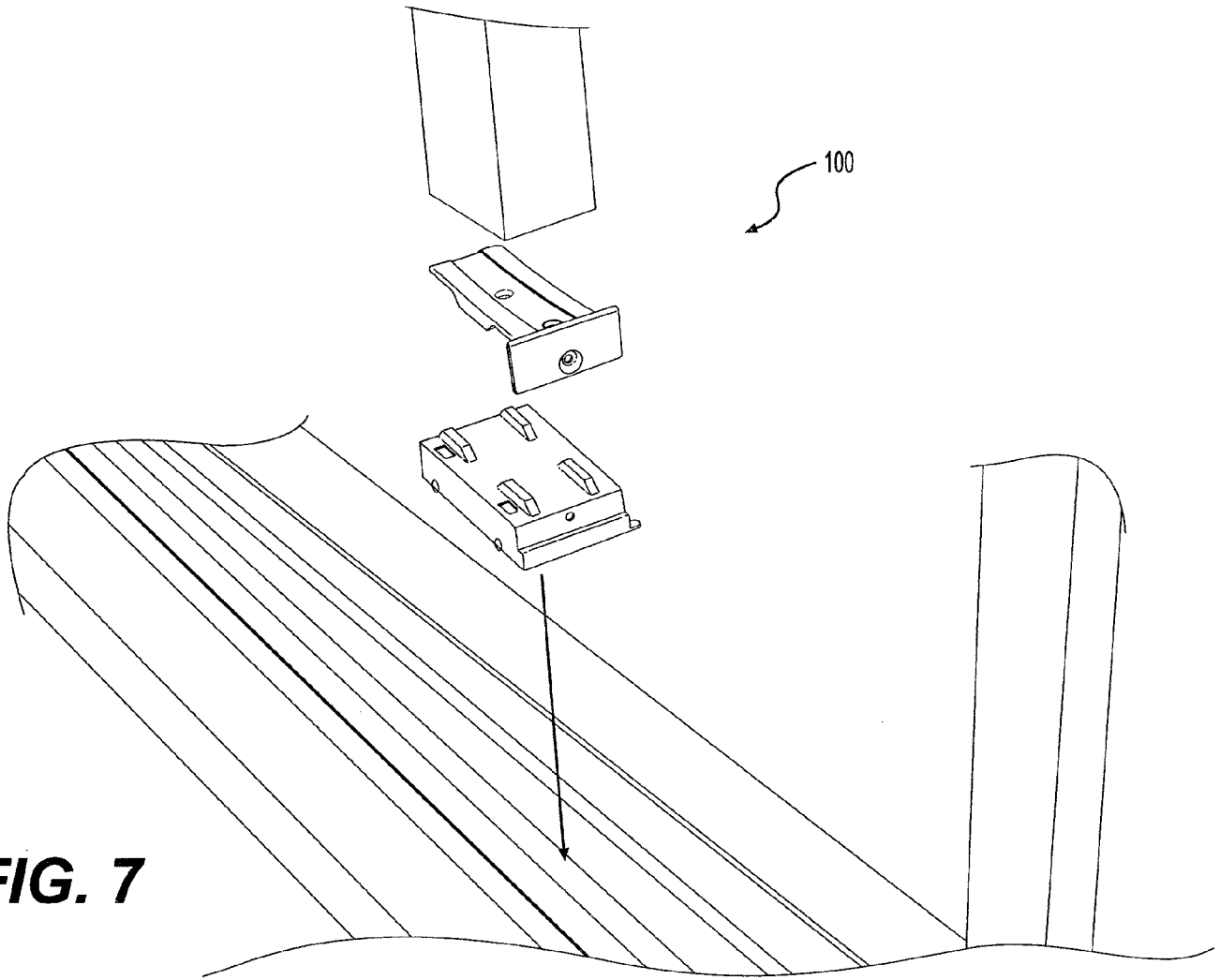
FIG. 7 is an exploded view of a roller assembly incorporating the roller of the present disclosure.

Referring to the drawings, FIG. 1 shows a sliding panel 300 incorporating a roller 100. In this regard, the roller 100 may be provided with a housing 110 and a plurality of wheels 120 may be positioned (e.g., captured) within the housing 110 (as shown in FIG. 2). While the figures show two pairs of wheels, it should be readily appreciable by those of skill in the art that more than two pairs may be used without departing from the spirit and scope of the invention. The roller can be connected to the panel 300 via any suitable connector, e.g., a connecting pin 100*p* integral with the roller 100 (as shown in FIG. 6) and configured to be received within a corresponding opening (not shown) provided in a bottom surface of the panel 300 or via a clip 111 (e.g., as discussed below in greater detail). Additionally, as shown in FIG. 5, the roller 100 is configured to be positioned in a space defined between a bottom surface of the panel 300*a* and a channel 3001 configured to receive a guided edge 300*e* of the panel.

Referring to FIG. 2, the plurality of wheels 120 of the roller 100 may include a first pair of wheels 120*a* and a second pair of wheels 120*b*. In this regard, the first pair of wheels 120*a* may be positioned at a first end of the housing 100 and the second pair of wheels 120*b* may be positioned at a second end of the housing 100. However, one of ordinary skill in the art would recognize that any suitable number of wheels capable of providing sliding movement to a panel may be employed without departing from the spirit and scope of the present invention.

Figure 3:
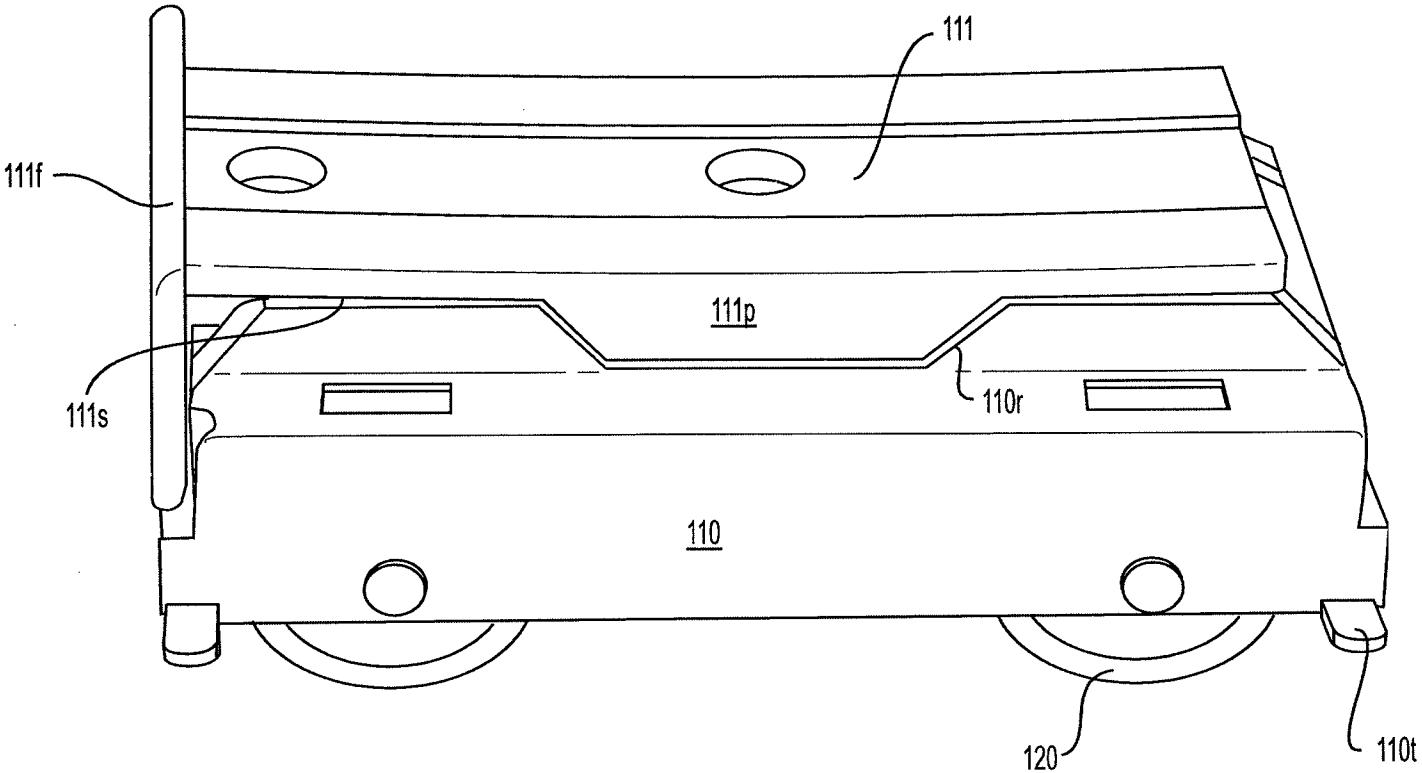
FIG. 3 is a perspective view of the roller including a clip mounted to an upper surface of the roller housing.
Figure 4:
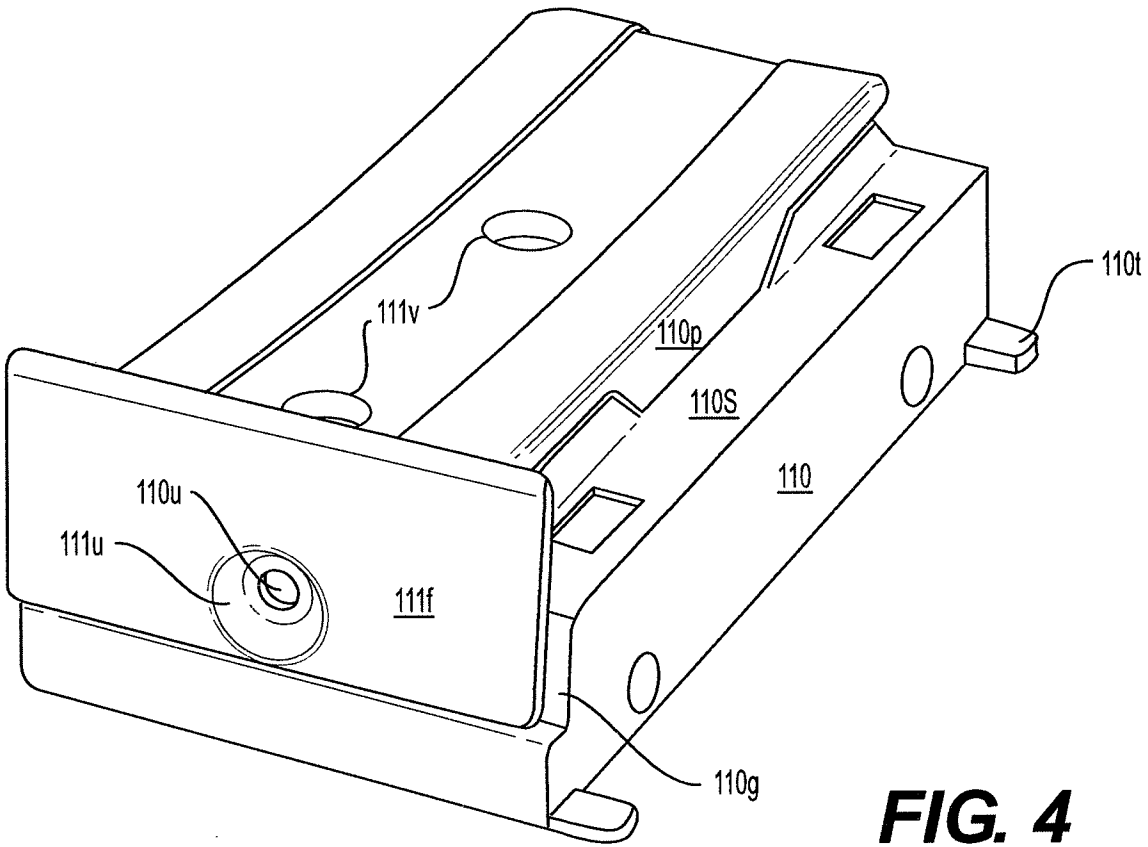
FIG. 4 is a perspective view of the roller illustrating a projection provided on a bottom surface of the clip positioned within a recess provided on an upper surface of the roller housing.

As shown in FIGS. 3 and 4, the roller 100 may also include a clip 111 coupled to an upper surface of the housing 110 and configured to be connected to the bottom surface of the panel 300*a*. In this regard, the clip 111 may facilitate alignment (or otherwise prevent displacement) of the roller 100 on the bottom surface of the panel 300*a*. For example, a lower surface of the clip 111*s* may be provided with a projection 111*p*, and the upper surface of the housing 110*s* may be provided with a recess 110*r* which receives the projection 111*p* of the clip 111.

Furthermore, FIGS. 3 and 4 illustrate the projection 111*p* provided at a central portion of the lower surface 111*s* of the clip 111 and the recess 110*r* provided at a central portion of the upper surface 110*s* of the housing 110. However, one of ordinary skill in the art would recognize that the projection and recess may be provided at any suitable position along a surface of the clip and housing, respectively. Additionally, one of ordinary skill in the art would recognize that the projection may be provided on a surface of the housing and the recess may be provided on a surface of the clip. Furthermore, one of ordinary skill in the art would recognize that the projection and recess may be provided in any cooperating shape and size. A non-limiting feature of this arrangement allows for the clip 111 to be easily centered when lowering it on top of the housing 110 for installation, which is advantageous when working with tight, low-tolerance panel installations.

Referring to FIGS. 3 and 4, the clip 111 may include a flange 111*f* extending generally perpendicular to the upper surface 110*s* of the housing 110. In this regard, the flange 111*f* may be received within a housing groove 110*g* provided in at least one of a first end of the housing 110 and a second end of the housing 110. Accordingly, the clip 111 and the housing 110 can be securely mated together for further alignment of the roller 100 at a bottom surface of the panel 300*a* (or to otherwise further prevent displacement).

Additionally, as shown in FIG. 4, the flange 111*f* may include a flange aperture 111*u* aligned with a housing aperture 110*u* provided in the at least one of the first and second ends of the housing 110. In this regard, a fastener 112 may be inserted through the flange aperture 111*u* and the housing aperture 110*u* so as to couple the clip 111 and the housing 110 together. Furthermore, it should be appreciated that the clip 111 may also be provided with suitable apertures 111*v* for connected the clip 111 to the bottom surface of the panel 300*a*.

Further, as shown in FIG. 3 the housing 110 may be provided with alignments tabs 110*t* proximate at least one of a first end of the housing 110 and a second end of the housing 110. In this regard, the alignment tabs 110*t* may be provided as, e.g., a reference to further align at least one of the first and second ends of the housing 110 with an end of the guided edge 300*e* of the panel 300. However, one of ordinary skill in the art would recognize that any suitable reference for aligning the roller may be employed, e.g., a mark, a depression or any other reference indicator intended to facilitate positioning of the roller.

Furthermore, it should be appreciated by one or ordinary skill in the art that panel 300 may be provided as a sliding window and the channel 301 may be provided as a window sill. Additionally, the sliding panel 300 may be provided as a door and the channel 301 may be provided as a door channel. However, one of ordinary skill in the art would recognize that the panel of the sliding assembly may be provided in other embodiments which require a panel to be slideably mounted.

Additionally, as shown in FIG. 5, the channel 301 may further include recessed pathways provided at opposing sides of the channel 301, thereby providing recessed pathways defining a sub-track 301*b* which receives and guides the plurality of wheels 120. In this regard, sliding movement of the roller 100 can be further improved by guiding the wheels 120 on the sub-track 301*b*.

Furthermore, as shown in FIG. 1, the roller 100 of the sliding panel assembly may include first and second rollers 100. In this regard, the first roller may be positioned at a first end of the guided edge 300*e* and the second roller may be positioned at a second end of the guided edge 300*e*. However, one of ordinary skill in the art would recognize that the sliding panel assembly may be provided with any number of rollers desired to facilitate sliding movement of the panel.

Furthermore, the roller 100 of the present invention allows for an easier insertion of a sliding panel 300 assembly.

In this regard, in a method of installing a sliding panel 300 assembly, a lower guided edge 300*e* of a sliding panel 300 may be inserted into a first groove 301 of a lower channel 301. Further, an upper guided edge of the panel may be rotated towards an upper channel. The panel 300*u* may then be raised so that the upper guided edge 300*u* is inserted into the upper channel and the roller 100 may be positioned in a space defined between a bottom surface 300*a* of the lower guided edge and the lower channel.

Further, in an embodiment where the roller 100 is incorporated in a window sill, the roller 100 may directly slide on the sill or a wear resistant material such as PVC fillers may be applied to the sill in order to prevent the material of the sill from wearing out due to operation of the rollers 100.

It should also be appreciated that the roller 100 of the present invention may be made of any suitable materials. For example, the housing 110 of the roller 100 may include a glass-reinforced nylon material, and the wheels 120 may include any material suitable for providing a reliable roller 100, e.g., plastic, metal, or any suitable composite material.

Additionally, it is noted that the roller 100 of the present invention is suitably for any sliding panel 300 arrangement including those used in outdoor environments which require a weather-resistant assembly.

Further, it is noted that the present invention may be provided with various additional features. For example, the wheels 120 may be individually captured within corresponding compartments 120*c* surrounding the individual wheels 120*b*. Additionally, a cross brace may be provided within the housing in order to strengthen the housing. In this regard, the cross brace may include a vertically extending cross piece 110*v* and a horizontally extending cross piece 110*h*, each spanning a distance defined between opposing side walls of the housing 110 (see, e.g., FIG. 2). Also, the pair of wheels 120*a*, 120*b* may be provided on a corresponding axle 120*x* which rotatably supports each pair of wheels.

However, one of ordinary skill in the art would readily recognize that any suitable feature for strengthening the housing may be employed without departing from the spirit of the present invention.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A roller for sliding a movable panel, the roller comprising:

a housing;

a plurality of wheels positioned within the housing, wherein the housing is configured to be positioned in a space defined between a bottom surface of the panel and a channel configured to receive a guided edge of the panel, the plurality of wheels comprising a first pair of wheels and a second pair of wheels, and the plurality of wheels being surrounded by compartments such that each said wheel is provided within a separate one of said compartments;

wherein the housing further comprises a horizontally extending cross-piece, which is separate from the compartments, extending between the first pair of wheels and the second pair of wheels; and a vertically extending cross-piece, which is separate from the compartments, extending perpendicular to the horizontally extending cross-piece and between the first pair of wheels, wherein the first pair of wheels are mounted on a first axle and the second pair of wheels are mounted on a second axle.

2. The roller according to claim 1, wherein the first pair of wheels are positioned at a first end of the housing and the second pair of wheels are positioned at a second end of the housing.

3. The roller according to claim 1, further comprising a clip coupled to an upper surface of the housing and configured to be connected to the bottom surface of the panel.

4. The roller according to claim 3, wherein a lower surface of the clip comprises a projection positioned within a recess provided on the upper surface of the housing.

5. The roller according to claim 4, wherein the projection is provided at a central portion of the lower surface of the clip and the recess is provided at a central portion of the upper surface of the housing.

6. The roller according to claim 4, wherein the clip comprises a flange extending generally perpendicular to the upper surface of the housing, the flange received within a housing groove provided in at least one of a first end of the housing and a second end of the housing.

7. The roller according to claim 6, wherein the flange comprises a flange aperture aligned with a housing aperture provided in the at least one of the first end of the housing and the second end of the housing, and a fastener received within the flange aperture and the housing aperture so as to couple the clip and the housing together.

8. The roller according to claim 1, wherein the housing comprises alignment tabs proximate at least one of a first end of the housing and a second end of the housing, the alignment tabs configured to align at least one of the first end of the housing and the second end of the housing with an edge of the guided edge of the panel.

9. The roller according to claim 1, wherein the horizontally extending cross-piece and the vertically extending cross-piece intersect each other at a center of the housing.

* * * * *